US009481978B2

(12) United States Patent
Seda et al.

(10) Patent No.: US 9,481,978 B2
(45) **Date of Patent: *Nov. 1, 2016**

(54) THUMB WITH DETACHABLE BODY

(71) Applicant: PALADIN BRANDS GROUP, INC., Oak Brook, IL (US)

(72) Inventors: Anthony G. Seda, Ravenna, OH (US); Robert J. Sikorski, Stow, OH (US)

(73) Assignee: Paladin Brands Group, Inc., Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/252,155

(22) Filed: Apr. 14, 2014

(65) Prior Publication Data

US 2014/0215866 A1 Aug. 7, 2014

Related U.S. Application Data

(63) Continuation of application No. 12/971,790, filed on Dec. 17, 2010, now Pat. No. 8,695,239.

(51) Int. Cl.
*E02F 3/96* (2006.01)
*E02F 3/40* (2006.01)

(52) U.S. Cl.
CPC *E02F 3/96* (2013.01); *E02F 3/404* (2013.01)

(58) Field of Classification Search
CPC ..... E02F 3/40; E02F 3/404; E02F 3/413; E02F 3/4131; E02F 3/4133; E02F 3/96
USPC ..... 37/403, 404, 405, 406, 407, 408, 409, 37/410, 468, 903; 172/439
See application file for complete search history.

(56) References Cited

U.S. PATENT DOCUMENTS

| | | | |
|---|---|---|---|
| 4,285,628 | A | 8/1981 | Jankowski |
| 4,519,739 | A | 5/1985 | Risch |
| 4,804,309 | A | 2/1989 | Risch |
| 4,907,356 | A | 3/1990 | Labounty |
| 5,094,581 | A | 3/1992 | Lamb |
| 5,111,602 | A | 5/1992 | Risch |
| 5,253,449 | A | 10/1993 | Webb et al. |
| 5,472,249 | A | 12/1995 | Fiedler |
| 5,472,308 | A | 12/1995 | Somero |
| 5,544,435 | A | 8/1996 | Somero |
| 5,553,408 | A | 9/1996 | Townsend |
| 5,678,332 | A | 10/1997 | Hawkins |
| 5,813,822 | A | 9/1998 | Pisco |

(Continued)

*Primary Examiner* — Jamie L McGowan
(74) *Attorney, Agent, or Firm* — Fay Sharpe LLP

(57) ABSTRACT

A thumb for an excavator includes a base with an inner end adapted to be connected to an excavator arm and an outer end, wherein the outer end of the base includes a body mount structure. A thumb body is releasably connected to the base. The body includes an outer working portion, an inner tail portion, and a coupling or pivot portion located between the working portion and the tail portion. The coupling portion of the body is engaged with the body mount structure of the base, and the tail portion of the body is releasably secured or captured to the base so that the body is located in an operative position for use of its working portion. The tail portion of the body includes first and second spaced-apart tail members. The tail portion of the body and the base include respective mating portions that are engaged with each other when the body is installed in its operative position on the base, and forces are transferred from the body to the base through these mating portions to minimize shear forces acting on the fasteners.

7 Claims, 10 Drawing Sheets

(56) References Cited

U.S. PATENT DOCUMENTS

| | | | |
|---|---|---|---|
| 5,957,650 | A | 9/1999 | Rollo |
| 6,088,938 | A | 7/2000 | Logan |
| 6,098,321 | A | 8/2000 | Logan |
| 6,131,978 | A | 10/2000 | Rounds |
| 6,523,284 | B1 | 2/2003 | Clugston |
| 6,655,053 | B1 | 12/2003 | Cummungs |
| 6,655,054 | B1 | 12/2003 | Ward |
| 6,742,291 | B2 | 6/2004 | Frigon et al. |
| 7,165,930 | B2 | 1/2007 | Pisco |
| 7,240,441 | B2 | 7/2007 | McCoy |
| 7,617,619 | B2 | 11/2009 | Cox |
| 7,673,403 | B2 | 3/2010 | Bridges |
| 7,818,901 | B2 | 10/2010 | Zeno et al. |
| 8,069,591 | B2 | 12/2011 | Dunn |
| 2002/0059741 | A1 | 5/2002 | Wolin et al. |
| 2002/0101107 | A1 | 8/2002 | Cunningham et al. |
| 2003/0167662 | A1 | 9/2003 | Desrochers |
| 2004/0187363 | A1 | 9/2004 | Larson |
| 2010/0058622 | A1 | 3/2010 | Calvert et al. |

THUMB WITH DETACHABLE BODY

CROSS REFERENCE TO RELATED APPLICATION

This application is a continuation of U.S. application Ser. No. 12/971,790 filed Dec. 17, 2010, now assigned U.S. Pat. No. 8,695,239, and the entire disclosure of said prior application is hereby expressly incorporated by reference into the present specification.

BACKGROUND

Thumbs for excavators are well known (the term "excavator" as used herein is intended to encompass excavators, backhoes, and other machines having an arm or "dipper stick" that carries a bucket or other work implement). These thumbs are secured to the arm of the excavator and are arranged relative to the bucket or other work implement so as to provide an opposable member to aid in grasping large or odd-shaped objects and/or for other purposes. The thumb includes a body having an inner end secured to the excavator arm and an outer end that is spaced outwardly from the arm. The outer end can have any of a wide variety of shapes and sizes, depending upon the work being performed, e.g., carrying logs, carrying demolition debris, lifting large rocks or metal plates, etc. These thumbs can be fixed, manually adjustable, or hydraulically adjustable.

U.S. Pat. No. 6,655,053 and U.S. Pat. No. 5,678,332 disclose excavator thumbs that include removable outer ends or implements that are selected and installed depending upon the type of work to be performed. The implements are telescopically installed on the inner portion of the thumb.

U.S. Pat. No. 7,240,441 discloses a thumb that is telescopically extendible and retractable as needed.

U.S. Pat. No. 5,553,408 discloses a thumb/claw for an excavator in which a mounting box is secured adjacent the excavator bucket, and either multiple clamping teeth or a single ripping tooth is/are operatively secured to the mounting box as needed.

U.S. Patent Application Publication No. 2010/0058622 discloses a thumb and a mounting structure for selectively and releasably connecting a tooth bar to the thumb.

U.S. Patent Application Publication No. 2002/0101107 discloses a thumb assembly that includes differently sized clamping assemblies that can be installed depending upon the type of work to be performed.

None of these prior thumbs have been found to provide a desired convenient and effective structure for selectively changing the outer working portion of the thumb as needed while also providing the required strength in a cost-effective and lightweight structure that is easy to use.

SUMMARY

In accordance with one aspect of the present development a thumb for an excavator includes a base comprising an inner end adapted to be connected to an excavator arm and an outer end, wherein the outer end of said base includes a body mount structure. The thumb also includes body releasably connected to the base. The body includes an outer working portion, an inner tail portion, and a coupling portion located between the working portion and the tail portion. The coupling portion of the body is engaged with the body mount structure of the base and the tail portion of the body is releasably fixedly secured to the base to capture the body to the base in an operative position for use of the working portion.

In accordance with another aspect of the present development, the tail portion of the thumb body is secured to the base with fasteners, and the tail portion and base include respective mating portions that are engaged with each other such that shear forces acting on the fasteners are reduced.

In accordance with another aspect of the present development, a thumb body is adapted to be connected to a base. The thumb body includes an outer working portion, an inner tail portion, and a coupling portion located between the working portion and the tail portion. The pivot portion of the body is adapted to be engaged with a body mount structure of an associated base and the tail portion of the body is adapted to be releasably fixedly secured to the associated base.

DETAILED DESCRIPTION

Figure 1:
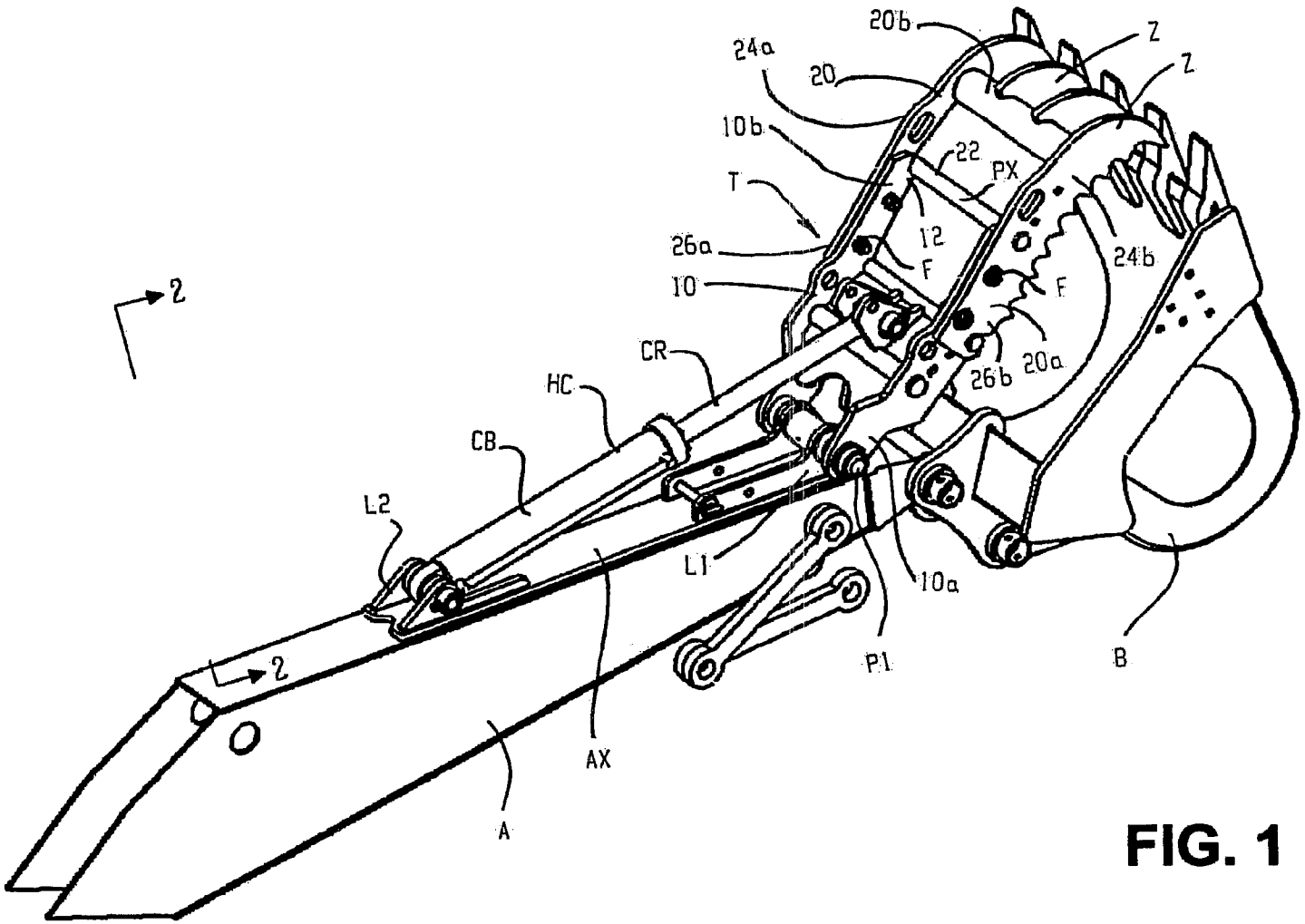
FIG. 1 is an isometric view of an excavator arm including a thumb formed in accordance with the present development.

FIG. 1 is an isometric view of an arm A of an excavator including a thumb T formed in accordance with the present development. As noted above, the term excavator is intended to encompass any construction machine such as an excavator, backhoe, tractor or the like having an arm A as shown to which a bucket B or other work attachment or implement is operably connected for performing work. The fully assembled thumb T is shown separately in FIGS. 2-4. The thumb T provides an opposable member that acts in conjunction with the bucket or other implement B to facilitate grasping of large objects and/or to facilitate other work.

Figure 5:
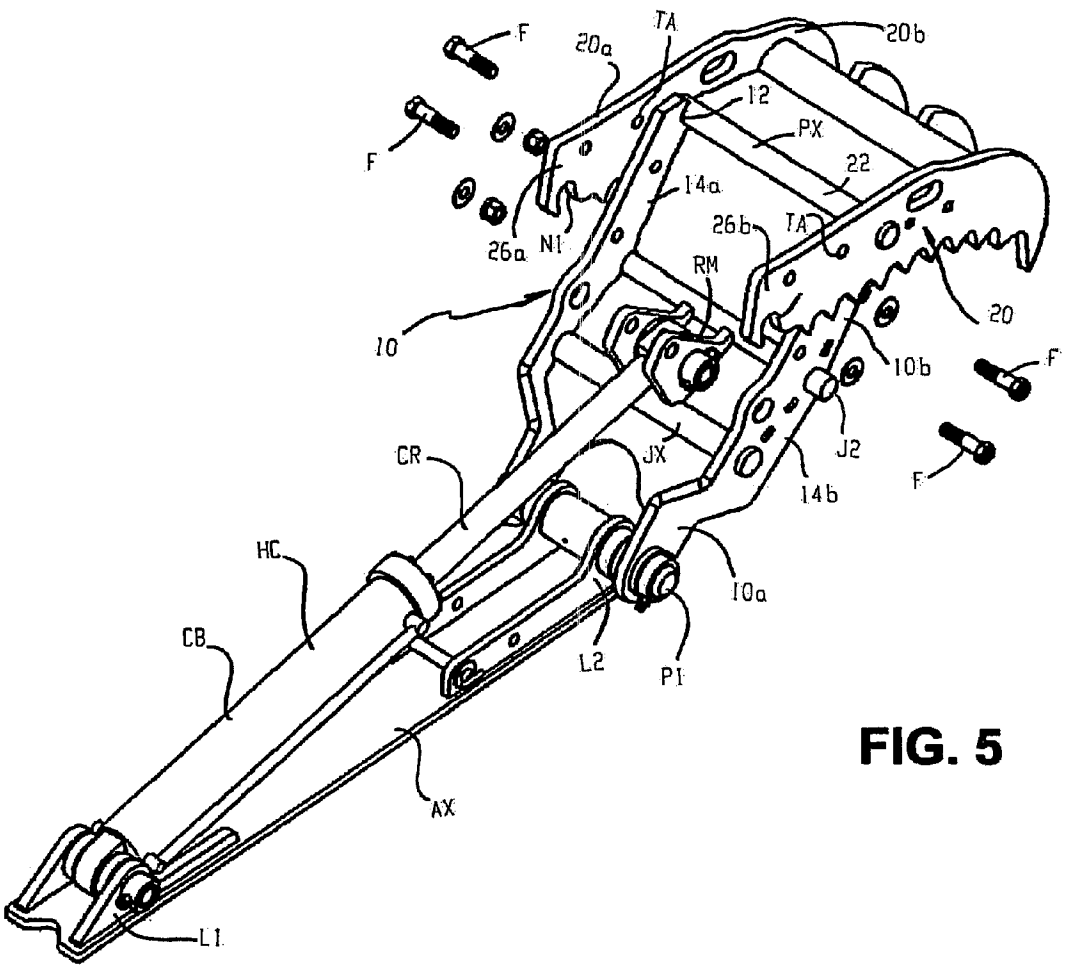
FIG. 5 is similar to FIG. 4, but shows the thumb in its partially assembled/disassembled or "intermediate" state.

The thumb T comprises a base 10 and a body 20 operably and releasably connected to the base 10. The base includes an inner end 10*a* connected to or adapted to be connected to the excavator arm A and an outer end 10*b*. The outer end 10*b* of the base includes a body mount or mount structure 12 for operably and releasably coupling the body 20 to the base. The body 20 comprises an inner tail or tail portion 20*a*, an outer working portion 20*b*, and a coupling structure or coupling portion 22 located between the tail portion 20*a* and the working portion 20*b*. The coupling portion 22 of the body is releasably engaged with the body mount 12 of the base 10 and the tail portion 20*a* of the body is releasably fixedly secured to the base 10 when the body 20 is installed in an operative position on the base 10. In the illustrated embodiment, the coupling portion 22 is provided as a pivot structure or pivot coupling that is rotatably engaged with the body mount 12 of the base, and the coupling portion 22 is thus sometimes referred to herein as a pivot portion 22. A plurality of removable pins, bolts or other fasteners F are used to releasably and fixedly secure the tail portion 20*a* of the body to the base 10 when the body 20 is installed in its operative position. When these fasteners F are removed and the pivot portion 22 of the body 20 is engaged with the body mount 12, the body 20 is in a pivotable state relative to the body 20 (see FIG. 5) such that the body 20 pivots relative to the base 10 by rotation of the pivot portion 22 relative to the body mount 12. FIG. 5 shows the body 20 pivoted to its partially assembled/disassembled or "intermediate" position relative to the base 10. When the body 20 is in this intermediate position, the coupling/pivot portion 22 is freely separable from the body mount 12 of the base 10 to separate the body 20 from the base without any interference between the tail portion 20*a* of the body and the base 10.

With continuing reference to FIGS. 1-5, the body 20 comprises first and second spaced-apart, parallel body side walls 24*a*,24*b* that are defined by respective ribs located on opposite lateral sides of the body. The outer working portion 20*b* of the body comprises a plurality of tines, teeth, and/or or other gripping/holding structures Z for performing work in conjunction with the bucket or other implement B carried by the arm A. Some of the tines Z can be provided by outwardly projecting portions of the side walls 24*a*,24*b* as shown for the thumb 20. A tube or other tine support member ZS (FIG. 2) extends between and is connected to the first and second body side walls 24*a*,24*b*, and at least some additional tines Z are connected to the tine support ZS.

The pivot portion 22 comprises a pivot cross-pin PX that extends between and interconnects the side walls 24*a*,24*b*. The pivot cross-pin comprises a cylindrical cross-section, at least where it is engaged by the body mount 12 of the base 10. In an alternative embodiment, the pivot cross-pin PX is replaced by first and second separate pivot shafts or bosses that project inwardly from the first and second side walls 24*a*,24*b*, respectively. In either case, the thumb body 20 pivots relative to the base 10 about an installation axis TX (FIG. 4) when the body 20 is in its pivotable state, i.e., when the fasteners F are removed.

In the illustrated embodiment, the tail portion 20*a* of the body 20 is defined by inwardly extending portions of the body side walls 24*a*,24*b* that extend inwardly from the pivot portion 22 away from the working portion 20*b*. In particular, inner portions of the first and second body ribs 24*a*,24*b* respectively define the first and second parallel, spaced-apart tails or tail members 26*a*,26*b* of the tail portion 20*a*.

The base 10 comprises first and second opposite lateral base side walls 14*a*,14*b* defined by parallel, spaced-apart base ribs. At the inner end 10*a* of the base, the side walls 14*a*,14*b* converge toward each other and comprise respective apertures defined therein that are aligned with each other and used for pivotally connecting the base 10 to the excavator arm A using a pin P1 inserted through the aligned apertures and a corresponding mounting aperture of the excavator arm A. The thumb base 10 pivots relative to the arm A about an axis that is parallel to the installation axis TX. The illustrated thumb embodiment is a hydraulic thumb that comprises an optional hydraulic cylinder actuator HC including a rod CR pivotally connected to the base 10 and a body CB pivotally connected to excavator arm A (or vice versa). The base 10 of the thumb T includes a mounting location RM for a pin-on pivoting connection of the rod R. The hydraulic cylinder HC is selectively actuated to control the angular position of the thumb T relative to the excavator arm A. As shown, a thumb connector AX is connected to the arm A and includes first and second mounting locations L1,L2 for pivoting connection of the thumb base 10 and the actuator HC, respectively.

The mount portion 12 of the base 10 comprises first and second recesses 16*a*,16*b* (FIG. 7) located respectively in the outer ends of the first and second base side walls 14*a*,14*b*. When the thumb body 20 is operatively connected to the base 10, the pivot portion 22 of the body, such as the pivot cross-pin PX, is received in and pivotally supported by the recesses 16*a*,16*b*.

Figure 2:
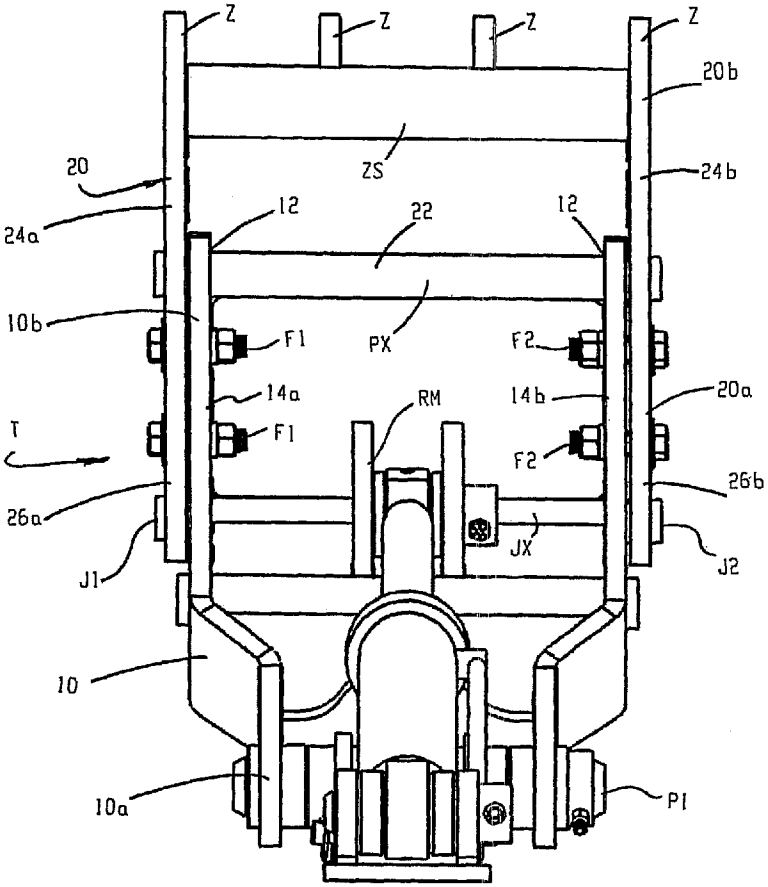
FIG. 2 is a view of the thumb of FIG. 1 as taken at line 2-2 of FIG. 1 (without showing the associated excavator arm to which the thumb is operatively connected)
Figure 3:
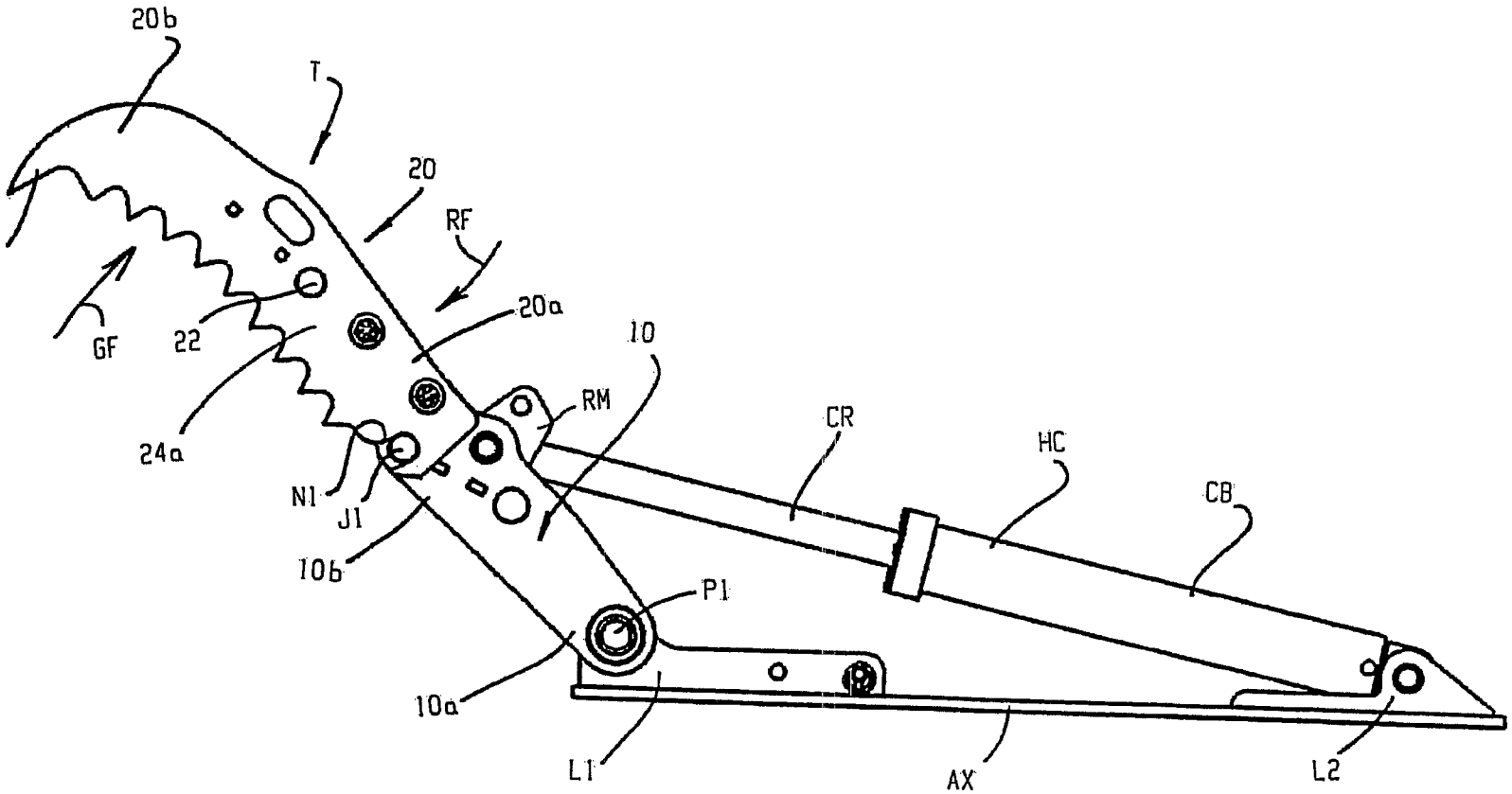
FIG. 3 is a side view of the thumb of FIG. 2.

As seen in FIG. 2, when the body 20 is operatively installed on the base 10, the first and second tail members 26*a*,26*b* are located respectively adjacent the first and second base side walls 14*a*,14*b*, with the base 10 nested between the tail members 26*a*,26*b*. The fasteners F comprise one or more first fasteners F1 that extend through and interconnect the first tail member 26*a* to the first base side wall 14*a*, and comprise one or more second fasteners F2 that extend through and interconnect the second tail member 26*b* to the second base side wall 14*b*. The overlapped portions of the first base side wall 14*a* and the first tail member 26*a* and the overlapped portions of the second base side wall 14*b* and the second tail member 26*b* define respective double-walled sections of the thumb T that provide added strength. The tail members 26*a*,26*b* each comprise at least one fastener-receiving aperture TA (FIG. 5) for receiving the fastener(s) F.

Figure 4:
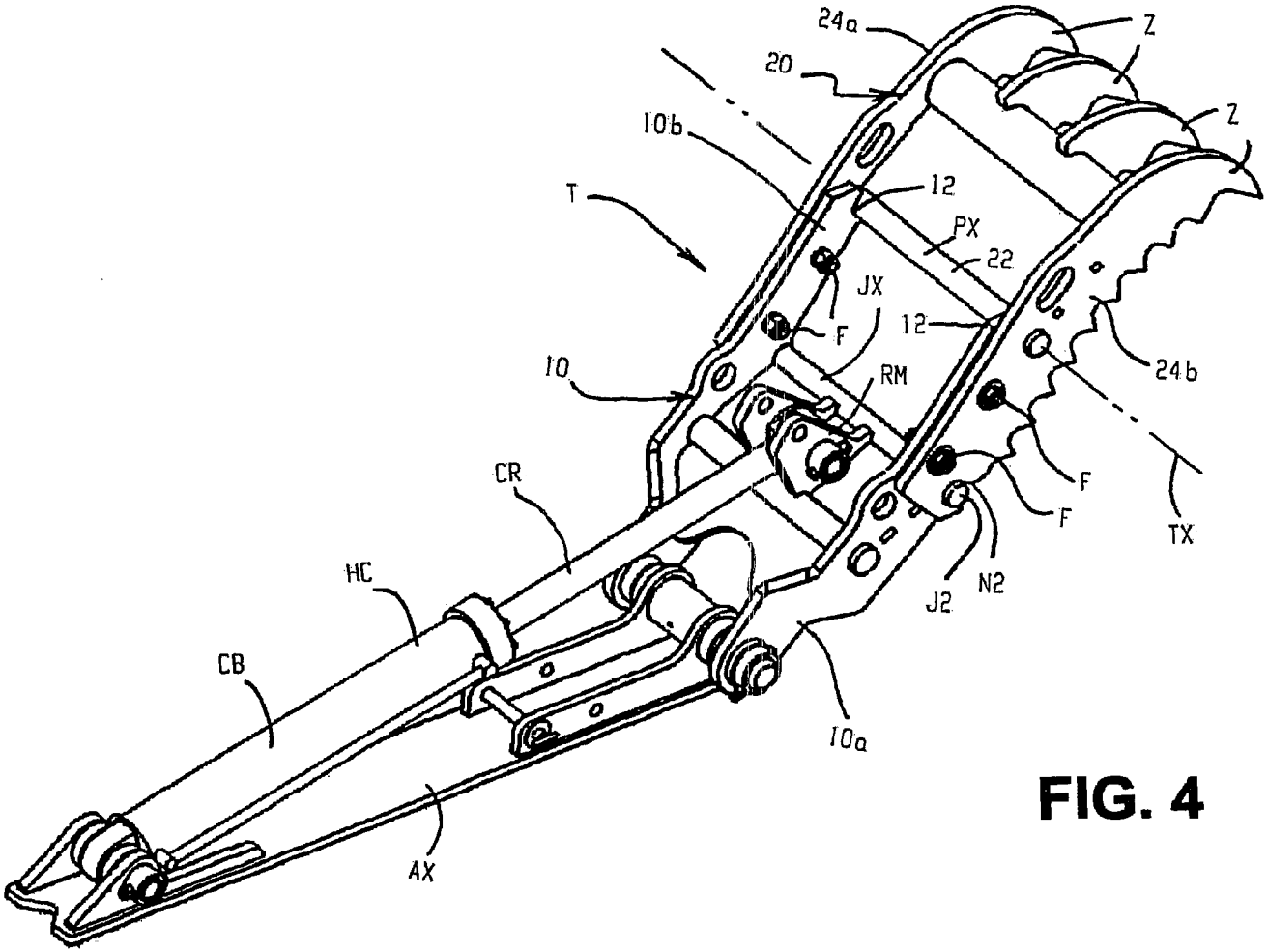
FIG. 4 is an isometric view of the thumb of FIG. 2.

It has been deemed desirable to minimize the shear forces acting on the fasteners F when the thumb T is in use as an opposable member for the bucket B or other attachment connected to the arm A. For this purpose, the tail portion 20*a* of the thumb body and the base 10 comprise respective mating portions that are engaged with each other when said body 20 is fully installed in its operative position on the base 10. As shown herein, at least one notch is formed in the tail portion 20*a*, e.g., first and second locator notches N1,N2 defined respectively in the first and second tail members 26*a*,26*b*. For each notch N1,N2, the base 10 comprises a corresponding locator lug or locator projection that is conformed and dimensioned and located to be received and retained in a respective notch N1,N2 when the thumb body 20 is pivoted from its intermediate position (FIG. 5) to its operative position (FIG. 4). As shown, a first projection J1 extends or projects outwardly from the base side wall 14*a* and is adapted to be received into the first notch N1, and a second projection J2 extends or projects outwardly from the base side wall 14*b* and is adapted to be received into the second notch N2 when the body is in its operative position. In the present embodiment, the projections J1,J2 are provided by the opposite projecting outer ends of a cross-bar JX that extends between the base side walls 14*a*,14*b*. In use of the thumb T, when a gripping force GF (FIG. 3) is exerted on the working portion 20*b* of the thumb body 20 when the body is operatively installed on the base 10, a reaction moment or force RF is exerted on the tail portion 20*a* of the body as shown in FIG. 2 due to the pivoting engagement of the pivot portion 22 with the body mount 12. The notches N1,N2 are shaped such that this reaction force RF is transferred from the tail members 26*a*,26*b* to the base 10 through the respective projections J1,J2. As such, shear forces on the fasteners F are avoided when the thumb is used for gripping operations. When the projections J1,J2 are fully received in the respective notches N1,N2, the thumb body is stopped against further pivoting movement and precisely located in its operative position so that the fasteners F can be installed through aligned apertures defined in the overlapped portions of the base and body side walls 14*a*,24*a* and 14*b*,24*b* (FIG. 2). As such, the projections J1,J2 provides first and second stops to position the thumb body 20 in its operative position and prevent pivoting movement of the body 20 away from the intermediate position beyond the operative position.

Figure 6A:
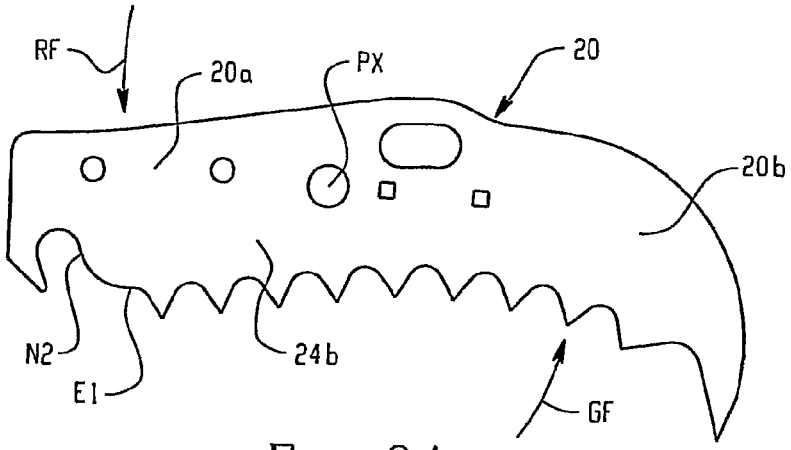
FIGS. 6A, 6B, 6C are side views that respectively illustrate three different thumb body embodiments.
Figure 6B:
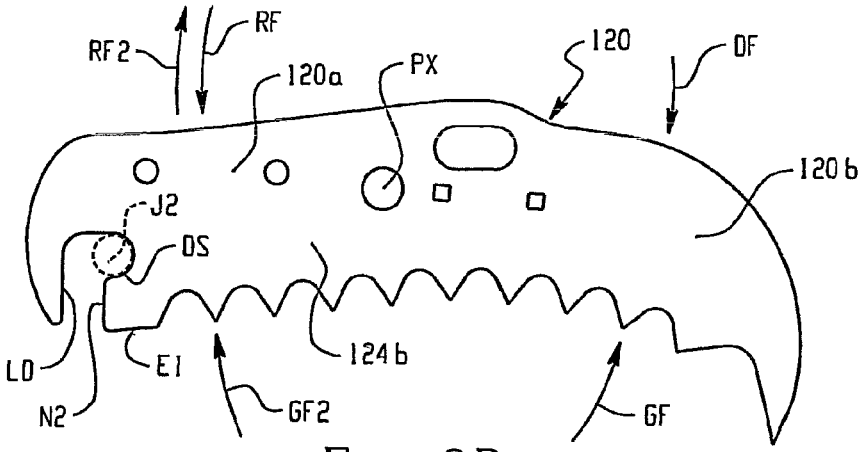
Figure 6C:
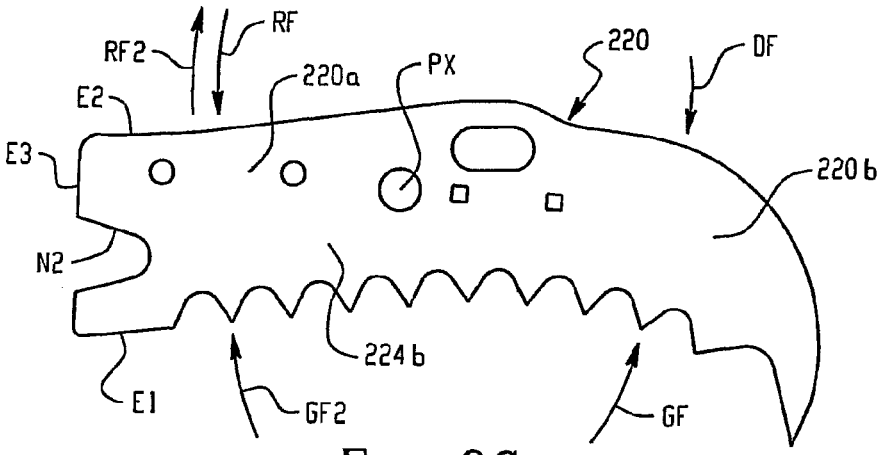

Referring to FIG. 6A, the notches N1,N2 of the thumb 20 are configured such that they open through the inner edges E1 of the respective body side walls 24*a*,24*b* (only the side wall 24*b* is shown, but the side wall 24*a* has the same structure), with the inner edge E1 being the edge of the side wall 24*a*,24*b* that is located on the working side of the thumb body 20 that is oriented toward and that is intended to contact the material being handled by the bucket B or other attachment/implement operably connected to the arm. FIG. 6B shows an alternative embodiment of a thumb body 120 that is identical to the thumb 20 except that the notches N1,N2 are shaped to include a dwell section DS located adjacent the closed inner end that receives and retains the projections J1,J2 (like components relative to the thumb body 20 are identified with like reference numbers that are 100 greater than those used for the thumb body 20). Because the dwell section DS extends transversely relative to a lead-in section/portion LD of each notch N1,N2 adjacent its open mouth, the presence of the projections J1,J2 seated in the dwell section DS prevents shear forces on the fasteners F due to the reaction force RF, a gripping GF2 oriented in the opposite direction as the reaction force RF and acting directly on the tail portion 120*a*, and also due to an opposite reaction force RF2 that acts on the tail portion 120*a* when a back-dragging force DF oriented opposite the gripping force GF is exerted on the working portion 120*b*. FIG. 6C shows another alternative embodiment of a thumb body 220 that is identical to the thumb body 20 except that the notches N1,N2 open through a transverse end or edge E3 of the body side wall 224*a*,224*b* that extends transversely between the inner edge E1 and an outer edge E2 (only the side wall 224*b* is shown in FIG. 6C, but the side wall 224*a* has the same structure). As such, the notches N1,N2 open in a direction oriented opposite the outer working portion 220*b* of the thumb body. Like the thumb 120, the thumb 220 is effective for preventing shear forces acting on the fasteners F due to the reaction force RF, a gripping GF2 oriented in the opposite direction as the reaction force RF and acting directly on the tail portion 220*a*, and also due to an opposite reaction force RF2 that acts on the tail portion 220*a* when a back-dragging force DF oriented opposite the gripping force GF is exerted on the working portion 220*b*.

Figure 7:
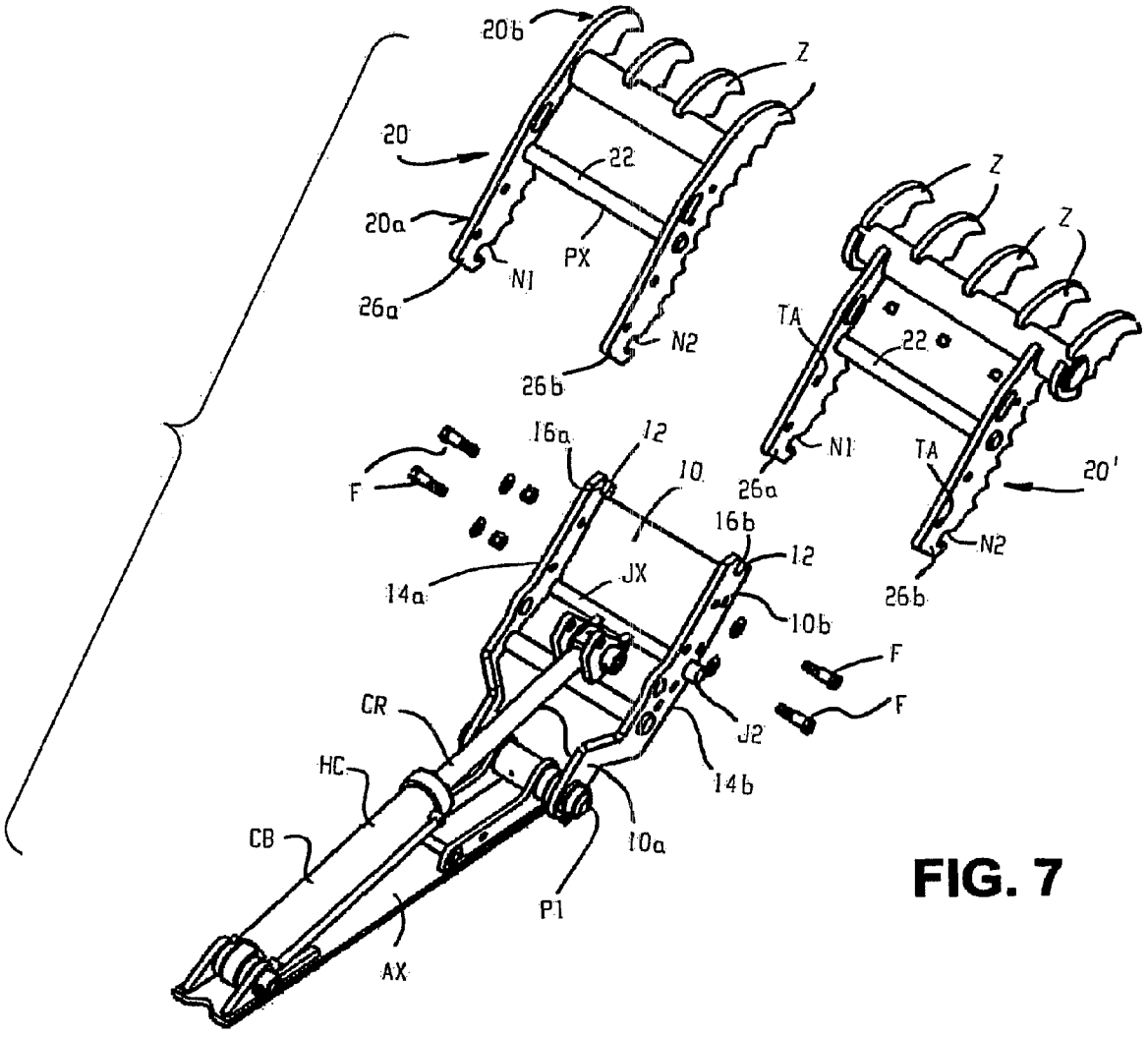
FIG. 7 provides an exploded view that shows the thumb body disconnected from the thumb base and also shows an alternative thumb body that can be operatively connected to the base.

FIG. 7 shows that different thumb bodies 20, 20' can be provided and operatively secured to the base 10 in an alternate fashion as needed and depending upon the type of work to be performed. The thumb bodies 20, 20' are each formed in accordance with the present development as described herein, but they include differently configured outer working portions 20*b* with respect to each other, e.g., with respect to the number and arrangement of the tines Z.

Figure 8:
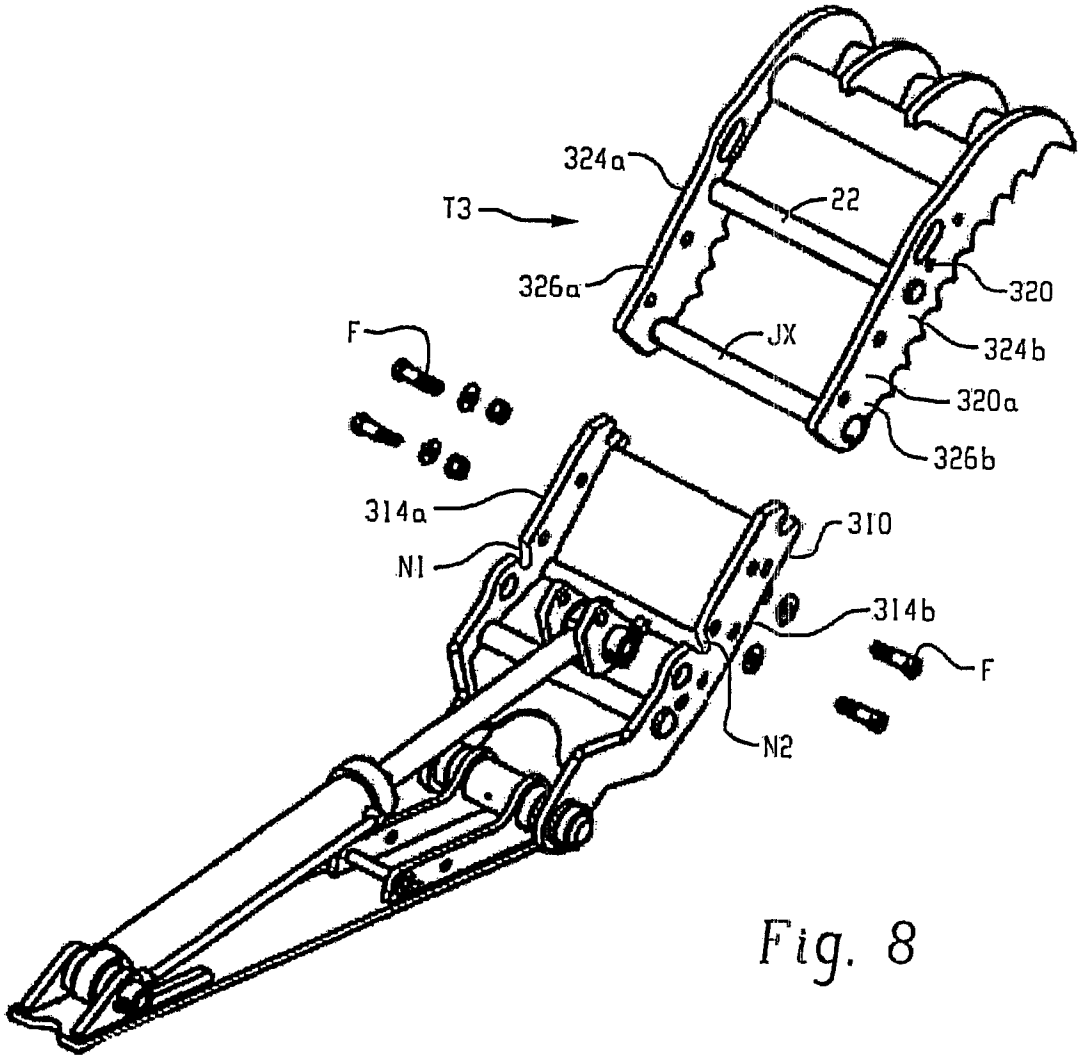
FIG. 8 is an isometric view of a thumb formed in accordance with an alternative embodiment, with the thumb body disconnected from the base.

FIG. 8 shows an alternative thumb T3 that is the same as the thumb T, except as shown and/or described. Like components relative to the thumb T are identified with like reference numbers that are 300 greater than those used for the thumb T. The base 310 is modified relative to the base 10 described above so that the projections J1,J2 are removed and the first and second locator notches N1,N2 are defined respectively in the first and second side walls 314*a*,314*b* of the base 310. The thumb body 320 comprises a cross-bar JX that extends between its side walls 324*a*,324*b*, and each notch N1,N2 receives and retains a respective portion of the cross-bar JX when the thumb body 320 is moved to its operative position on the base 310. The fasteners F are used to secure the thumb body 320 to its base 310 in the operative position as described above. When the cross-bar JX is seated in the notches N1,N2, any reaction force RF (see FIG. 3) acting on the tail portion 320*a* during use of the thumb T3 will be transferred to the base 310 through the cross-bar JX and the recesses N1,N2 to minimize shear forces acting on the fasteners F. The cross-bar JX can be replaced by first and/or second separate locating projections such as shafts or bosses that are connected respectively to the first and second tail members 326*a*,326*b* and that extend inwardly toward each other so as to be located to be received respectively in the notches N1,N2.

Figure 9:
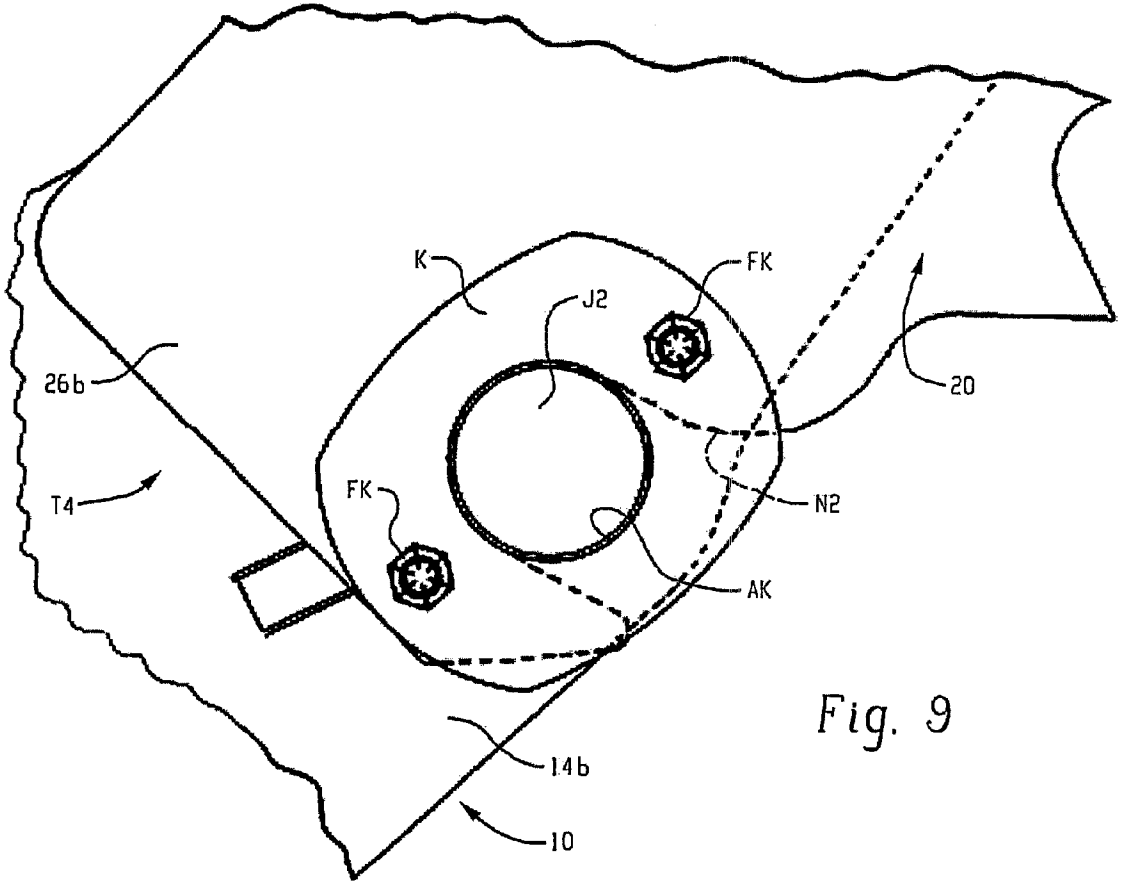
FIGS. 9 and 10 respectively show further alternative embodiments of a thumb provided in accordance with the present development.

FIG. 9 is a partial view of another alternative thumb embodiment T4 that is the same as the thumb T, except as shown and/or described. As such, like components relative to the thumb T are identified with like reference numbers. The thumb T4 eliminates the fasteners F and replaces them with a keeper K for each tail member 26*a*,26*b* (only the tail portion 26*b* and its respective keeper K are shown but the tail member 26*a* and its keeper K are correspondingly formed). The keeper K is shown as a washer that is selectively connected to the tail member 26*b*, but the keeper K is alternatively provided as any member that is movably or selectively connected to the tail member 26*b* and that at least partially blocks the notch N2 when it is operably positioned or installed so that the keeper K captures the projection J2 of the base 10 in the notch N2. As noted, although it is not shown in FIG. 9, a separate keeper K is provided to selectively block or at least partially block the notch N1 of the tail member 26*a* to capture the corresponding projection J1 therein. The use of a washer for the keepers K, as shown herein, enables the keepers K to encircle the respective projections J1,J2 such that the keepers K provides added strength to the interfaces between the projections J1,J2 and the tail members 26*a*,26*b*. In such case, the washer keeper K is closely received on the projection J1,J2 with minimal clearance between the projection and the aperture AK of the keeper washer K. In the illustrated embodiment, first and second removable bolts or other fasteners FK are used to selectively connect the keeper to the tail member 26*b*. Alternatively, a keeper K is provided as a latch or other member that is slidably or otherwise movably connected to each tail member 26*a*,26*b* and that is selectively movable to a position where it at least partially blocks the respective notch N1,N2 to capture the corresponding projection J1,J2 therein. Those of ordinary skill in the art will recognize that, regardless of the exact form of the keeper K provided for each tail member 26*a*,26*b*, the keepers K also serve to secure the tail portion 20*a* of the body 20 to the base 10 in an operative position for use of the thumb T4 due to the fact that the projections J1,J2 are captured in their respective notches N1,N2.

Figure 10:
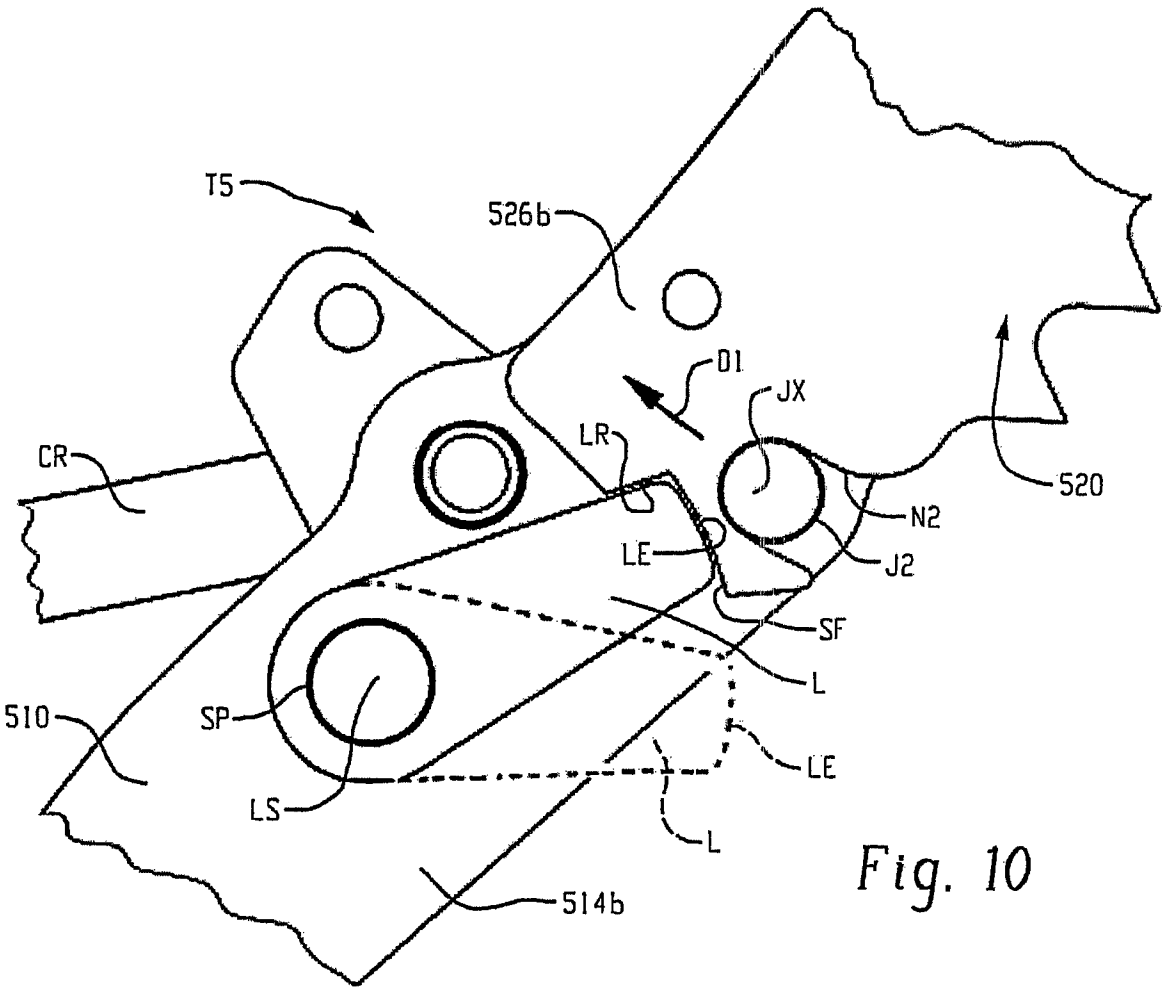

FIG. 10 is a partial view of another alternative thumb embodiment T5 that is the same as the thumb T, except as shown and/or described. As such, like components of the thumb T5 relative to the thumb T are identified with like reference numbers that are 500 greater than those used in connection with the description of the thumb T. The thumb T5 eliminates the fasteners F and replaces them with first and second latches L that are respectively movably connected to the first and second base side walls 514*a*,514*b*

(only the base side wall 514*b* and its respective latch L are shown in FIG. 10, but the base side wall 514*a* also includes a respective latch L movably connected thereto in a corresponding manner). The latch L moves between a latched or engaged position (shown in solid lines) and an unlatched or disengaged position (shown in broken lines). The latch L is spring-biased by a torsion spring or other spring SP into its engaged position but is selectively manually movable to its disengaged position. A stop is provided to ensure that the spring SP does not rotate the latch L away from its disengaged position beyond its engaged position when the latch L is otherwise in a free state. The latch L is pivotally connected to its respective base side wall 514*b* by a pivot shaft LS, and the biasing spring SP can be coaxially positioned on the pivot shaft or can be otherwise located depending upon its structure. When the thumb body 520 is installed in its operative position on the base 510 and the latch L is engaged, the latch L blocks movement of the body tail member 526*b* from its installed operative position in the direction D1 to its intermediate position as is required to separate the notch N2 from its projection J2 (the latch L of first base side wall 514*a* acts in the same manner to block movement of the body tail member 526*a* in the direction D1 from its operative position to its intermediate position as required to separate the first notch N1 from the first projection J1). In the illustrated embodiment, the tail members 526*a*,526*b* each include or define a recess LR. When the thumb body 520 is operatively installed and the latch L is engaged, an outer end of the respective latch L is received in the recess LR. The recess LR includes a stop face SF that is located adjacent and/or abutted with an end face LE of the latch. Abutment of the stop face SF with the latch end face LE blocks movement of the tail members 526*a*,526*b* in the direction D1. When the latches L respectively associated with the first and second base side walls 514*a*,514*b* are each moved to their unlatched/disengaged position, the latch end face LE is moved away from the stop face SF and the latch L allows movement of the respective tail members 526*a*, 526*b* in the direction D1 from the operative installed position toward the intermediate position as required for separation of the thumb body 520 from the base 510. As such, the latches L capture the projections J1,J2 in the respective notches N1,N2 and also capture the thumb body 520 to the base 510. When the thumb body 520 is being installed on the base 510 and the tail members 526*a*,526*b* are moving from the intermediate position toward the operative position in a direction opposite the direction D1, the tail members 526*a*, 526*b* contact the respective latches L on the opposite side walls 514*a*,514*b* of the base 510 and urge the latches L toward their disengaged positions so that the projections J1,J2 move fully into the respective notches N1,N2 without interference from the latches, at which time the latches L automatically return to their latched positions by force of their resilient biasing springs SP. As such, no operator manipulation of the latches L is required when installing the thumb body 520 to the base 510, but the latches L must be manually moved to their disengaged positions by an operator in order to separate the thumb body 520 from the base 510.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A thumb for an excavator, said thumb comprising:

a base comprising an inner end adapted to be connected to an excavator arm and an outer end, wherein said outer end of said base includes a body mount structure that comprises first and second spaced-apart recesses located respectively in outer ends of first and second spaced-apart base side walls located on opposite lateral sides of said base;

a body releasably connected to the base, said body comprising an outer working portion, an inner tail portion, and a pivot portion located between the outer working portion and the tail portion, wherein said tail portion of said body comprises first and second tail members that extend from said pivot portion of said body away from said working portion of said body;

wherein said pivot portion of said body is engaged with both said first and second spaced-apart recesses of said body mount structure of said base and wherein said tail portion of said body and said base comprise respective mating portions that are engaged with each other when said body is installed in its operative position on said base such that said tail portion of said body is selectively releasably captured to said base in an operative position for use of said working portion, said tail portion of said body selectively releasable from said base to allow pivoting movement of said body relative to said base at said interface of said body pivot portion and said first and second recesses from said operative position to an intermediate position where said pivot portion of said body is separable from said first and second recesses of said base, said respective mating portions of said body and said base comprising: a first notch located in said first tail member; a second notch located in said second tail member; a first projection extending outwardly from said first side wall of said base; and, a second projection extending outwardly from said second side wall of said base, wherein said first notch mates with said first projection and said second notch mates with said second projection when said body is located in its operative position;

a first keeper connected to said first tail member and at least partially blocking said first notch such that said first keeper captures said first projection in said first notch; and, a second keeper connected to said second tail member and at least partially blocking said second notch such that said second keeper captures said second projection in said second notch;

wherein said first and second keepers each comprise a washer including an aperture, and said first and second keepers are respectively received on the first and second projections with the first and second projections extending through the respective apertures of the first and second keepers.

2. The thumb as set forth in claim 1, wherein said body comprises first and second spaced-apart body ribs and wherein said first tail member is defined by an extending portion of said first body rib and said second tail member is defined by an extending portion of said second body rib.

3. The thumb as set forth in claim 1, wherein:

said first and second tail members each comprise an inner edge oriented toward a working side of said thumb that is adapted to engage material being handled, an outer edge spaced from and oriented opposite the inner edge, and a transverse edge that extends between and interconnects the inner and outer edges;

said first notch includes an open mouth that opens through said inner edge or that opens through said transverse edge of said first tail member; and, said second notch includes an open mouth that opens through said inner edge or that opens through said transverse edge of said second tail member.

4. The thumb as set forth in claim 3, wherein:

said open mouth of said first notch opens through said inner edge of said first tail member;

said open mouth of said second notch opens through said inner edge of said second tail member;

said first and second notches each comprise a lead-in section and a dwell section that extends transversely relative to the lead-in section, wherein the lead-in section is located adjacent the open mouth of the respective notch and the dwell section is located adjacent a closed inner end of the respective notch.

5. The thumb as set forth in claim 1, wherein:

a gripping force exerted on the working portion of said body when said body is operatively installed on said base results in a reaction force exerted on said tail portion of said body; and said respective mating portions of said base and said tail portion of said body are configured such that at least part of the reaction force is transferred to said base from said tail portion through said respective mating portions.

6. The thumb as set forth in claim 1, wherein:

said pivot portion of said body comprises a cross-pin that extends between opposite first and second sides of said body;

a first side of said cross-pin adjacent the first side of the body is seated in said first recess; and a second side of said cross-pin adjacent the second side of the body is seated in said second recess.

7. The thumb as set forth in claim 6, wherein said cross-pin is rotatably engaged with said first and second recesses of said body mount structure such that said body is pivotable relative to said base when said tail portion of said body is released relative to said base.

* * * * *